US005370255A

United States Patent [19]

Yang

[11] Patent Number: 5,370,255

[45] Date of Patent: Dec. 6, 1994

[54] COLLAPSIBLE MULTILAYER CONTAINER

[76] Inventor: Teng-Feng Yang, No. 1 Wu-Fen-Lu-Chiao, Pa-Te, Tao-Yuan Hsien, Taiwan, Prov. of China

[21] Appl. No.: 227,001

[22] Filed: Apr. 13, 1994

[51] Int. Cl.[5] ..... A47B 47/00

[52] U.S. Cl. ..... 220/4.27; 220/4.22; 220/520; 312/201

[58] Field of Search ..... 220/6, 4.22, 4.26, 4.27, 220/23.2, 520, 525, 526; 312/269, 270.2, 300, 201

[56] References Cited

U.S. PATENT DOCUMENTS

| | | | |
|---|---|---|---|
| 245,855 | 8/1881 | Morrison | 312/201 X |
| 570,199 | 10/1896 | Caplinger | 220/525 X |
| 1,157,008 | 10/1915 | Lang | 220/4.22 X |
| 1,289,657 | 12/1918 | Cheney | 312/201 |
| 2,429,290 | 10/1947 | Mueller | 220/4.27 X |
| 2,582,421 | 1/1952 | Essman | 312/201 |
| 2,624,451 | 1/1953 | Ewing | 220/4.22 X |
| 2,663,608 | 12/1953 | Schauer | 220/4.27 X |
| 3,392,868 | 7/1968 | Pfrommer | 220/520 |
| 4,239,308 | 12/1980 | Bradley | 312/300 X |
| 4,616,752 | 10/1986 | Ridgley | 220/4.27 X |

*Primary Examiner*—Steven M. Pollard
*Attorney, Agent, or Firm*—Poms, Smith, Lande & Rose

[57] ABSTRACT

A collapsible multilayer container includes a cover and a plurality of housings in which the housings are pivotally connected one by one so as to be collapsible for spacial savings and expandable for charming outlooks. The cover includes a pair of handles pivotally connected thereto for carrying purpose. And, the cover and the housings are securely locked together by a locking device.

5 Claims, 5 Drawing Sheets

COLLAPSIBLE MULTILAYER CONTAINER

FIELD OF THE INVENTION

The present invention relates generally to a container, and more particularly to a collapsible multilayer container comprising a plurality of housings which can be expanded or piled up.

BACKGROUND OF THE INVENTION

A conventional container for storing articles such as chain, ring, and needle and thread generally comprises a cover and a housing in which the cover is secured to the housing in an openable manner.

But, storing articles may be the only one function such container can have. And, the size of the container is huge and inconvenient for carrying when lots of articles are stored. Or, only a packet size container is possible for easy transport but impractical.

SUMMARY OF THE INVENTION

Accordingly, it is a primary object of the present invention to provide a collapsible multilayer container comprising a plurality of housings for storing articles to overcome the problems of the prior art.

It is another object of the present invention to provide a collapsible multilayer container comprising a locking device to securely lock the container.

In accordance with the above-mentioned objects, a collapsible multilayer container comprises a cover and a plurality of housings in which the housings are pivotally connected one by one so as to be collapsible for spacial savings and expandable for charming outlooks. And, the cover and the housings are securely locked together by a locking device which comprises a pair of first guiding members mounted on the cover, a pair of second guiding members mounted on the housings, and a pair of locking members.

The above objects, features and advantages of the present invention will become readily apparent from the following detailed description thereof which is to be read in connection with the accompanying drawings.

DETAILED DESCRIPTION OF THE PREFERRED EMBODIMENT

Figure 1:
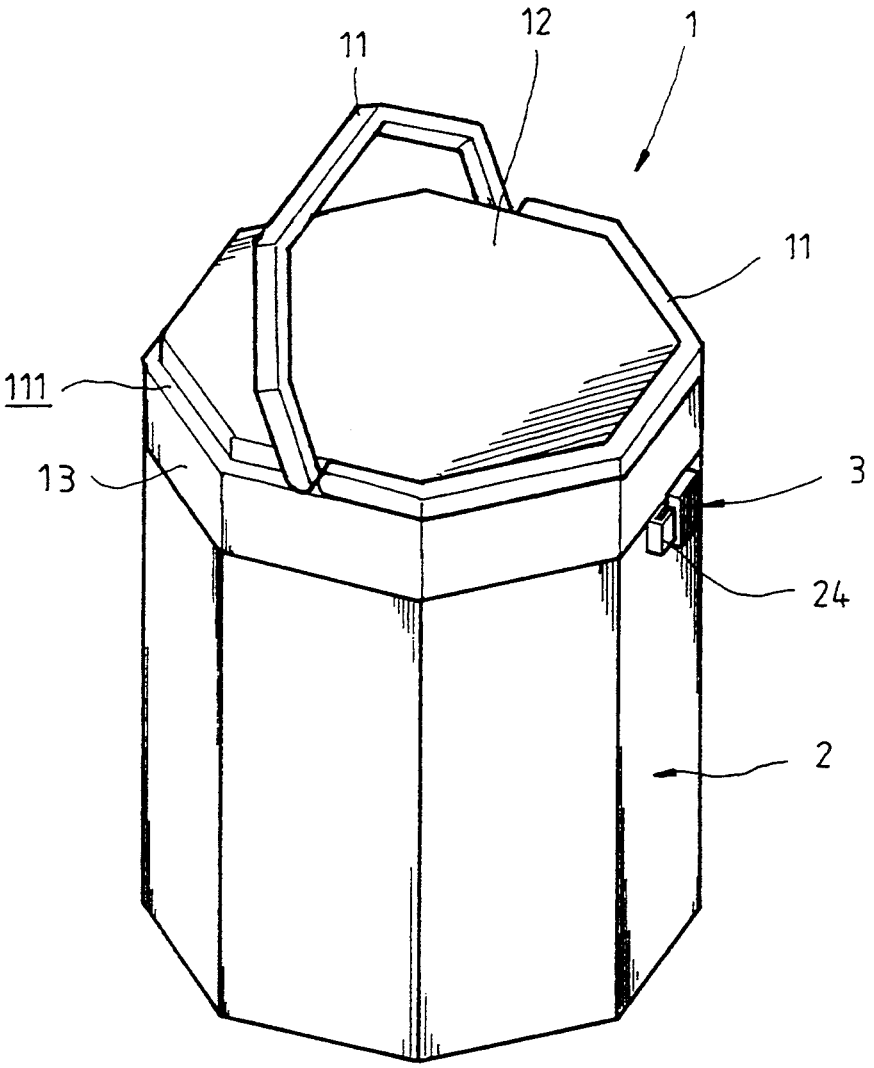
FIG. 1 is a perspective view of a collapsible multilayer container in accordance with the present invention.
Figure 2:
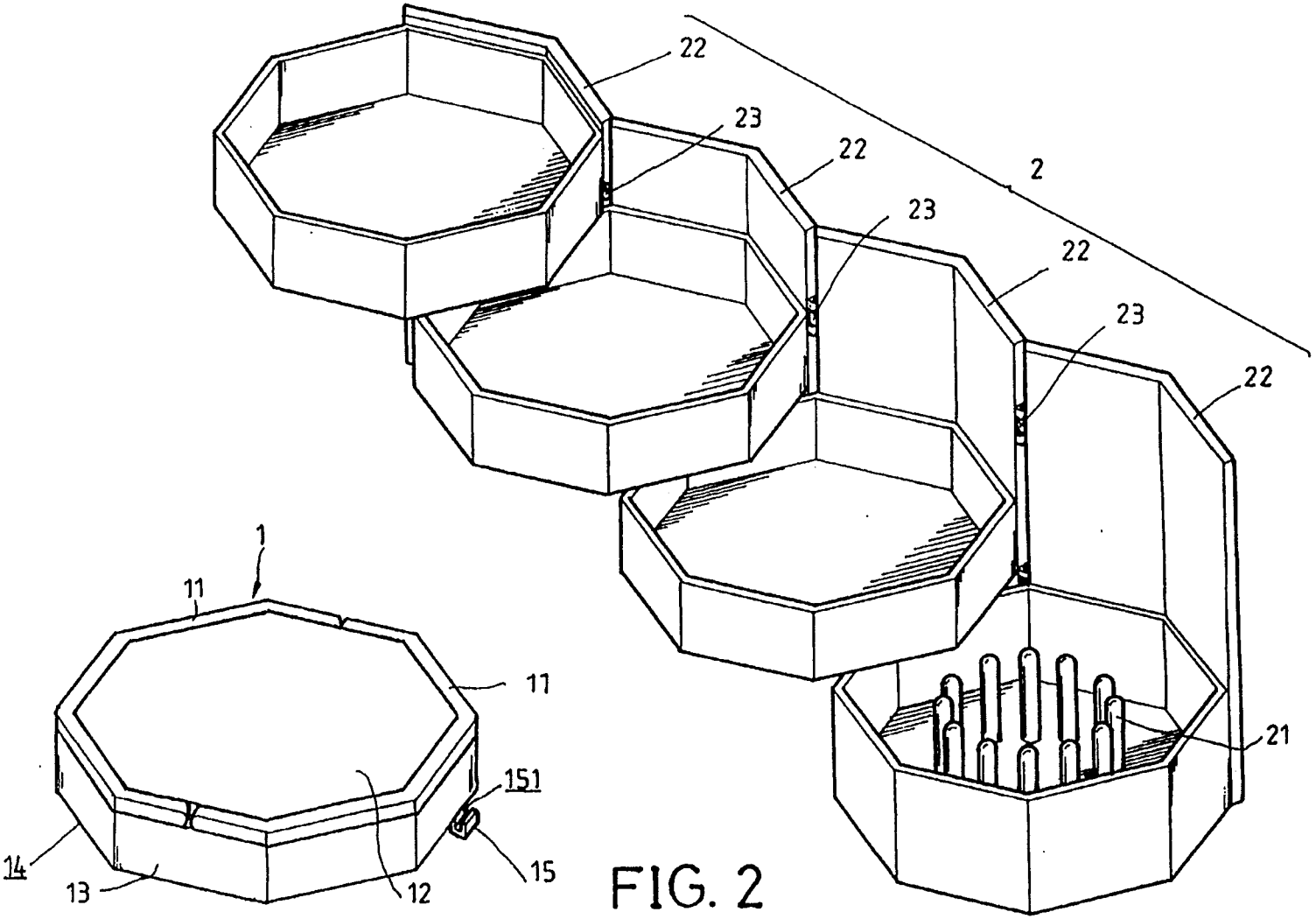
FIG. 2 is a perspective view of the collapsible multilayer container in an expanded status in accordance with the present invention.
Figure 5:
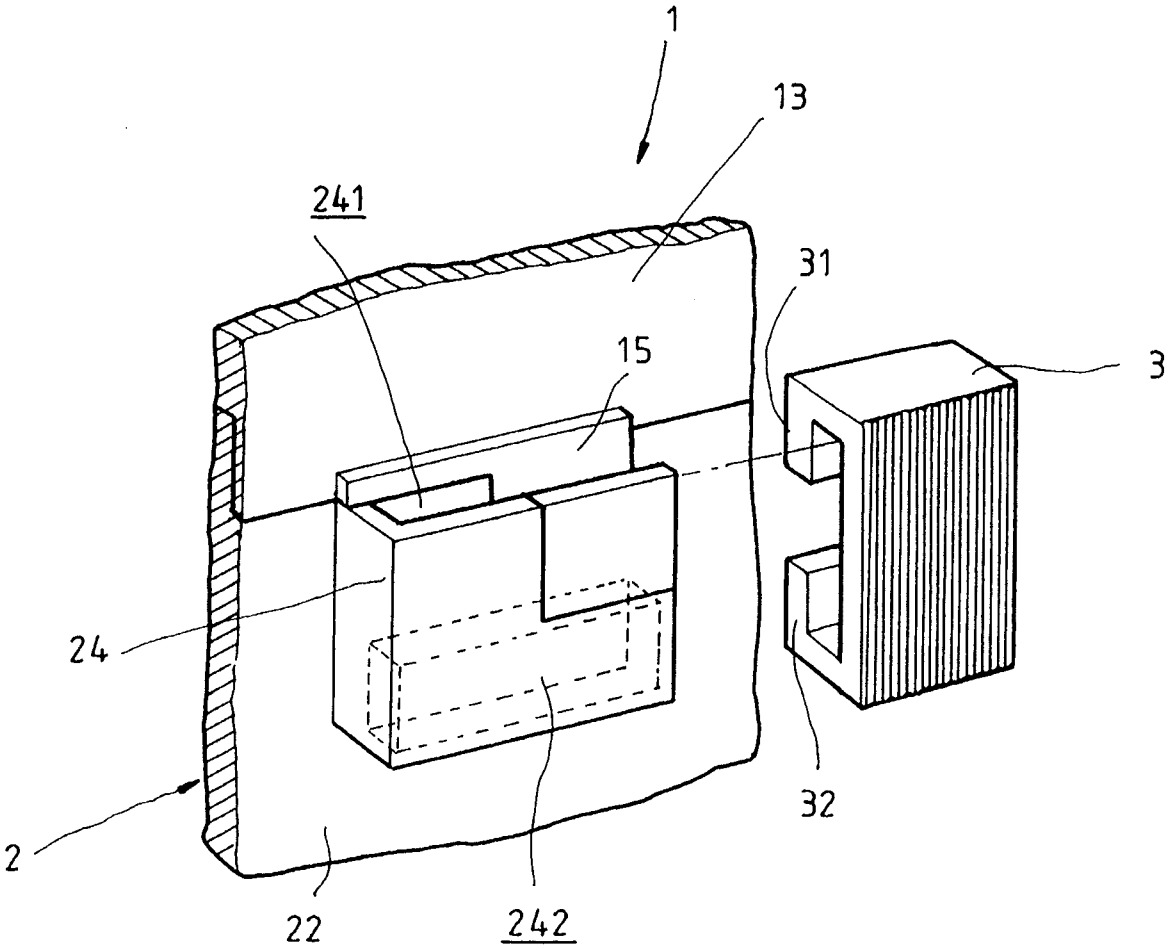
FIG. 5 is an enlarged perspective view of a guiding assembly and a locking member of the collapsible multilayer container in accordance with the present invention.

Referring to the drawings and in particular to FIGS. 1 and 2, a collapsible multilayer container constructed in accordance with the present invention comprises an octagonal cover 1, a plurality of collapsible octagonal housings 2, and a pair of inverse C-shaped locking members 3, each locking member 3 having an upper downward bend 31 and a lower upward bend 32 formed thereof (see FIG. 5).

The cover 1 comprises a pair of handles 11, a base 12, and an octagonal raiser 13 in which the raiser 13 encircles the base 12 and extends downwardly from the base 12 to form an open lower end 14 of the cover 1. An octagonal groove 111 is formed on the exterior rim corner of the cover 1 between the base 12 and the raiser 13 to dispose therein the handles 11. The handles 11 are pivotally connected to the cover 1 for carrying purposes. The cover 1 further comprises a pair of first guiding members 15 externally secured onto two opposite sides thereof. Each of the first guiding members 15 appears U-shaped and has a groove 151 formed thereon to guide and receive therein the upper bend 31 of each locking member 3.

Each of the collapsible octagonal housings 2 defines an internal space having a top opening which is like an inversion of the cover 1, preferably for receiving therein articles such as chain, ring, or needle and thread. For example, as shown in FIG. 2, the bottom one of the housings 2 has a larger internal space than that of the others comprises a plurality of rods 21 formed therein for receiving threads wound there around.

Each of the collapsible octagonal housings 2 comprises a fence 22 in the form of an extension portion partly attached thereto and extending upwardly from the bottom of the housing 2 in various predetermined lengths. The length of each fence 22 is longer than the height of each corresponding housing 2 and longer enough to embrace therein all the others of the housings 2 piled up above. For example, as shown in FIG. 2, the fence length of the bottom housing 2 is longer enough to embrace therein the other three of the housings 2 and the fence length of the housing 2 next to the bottom one is longer enough to embrace therein the other two of the housings 2 and so on.

Figure 3:
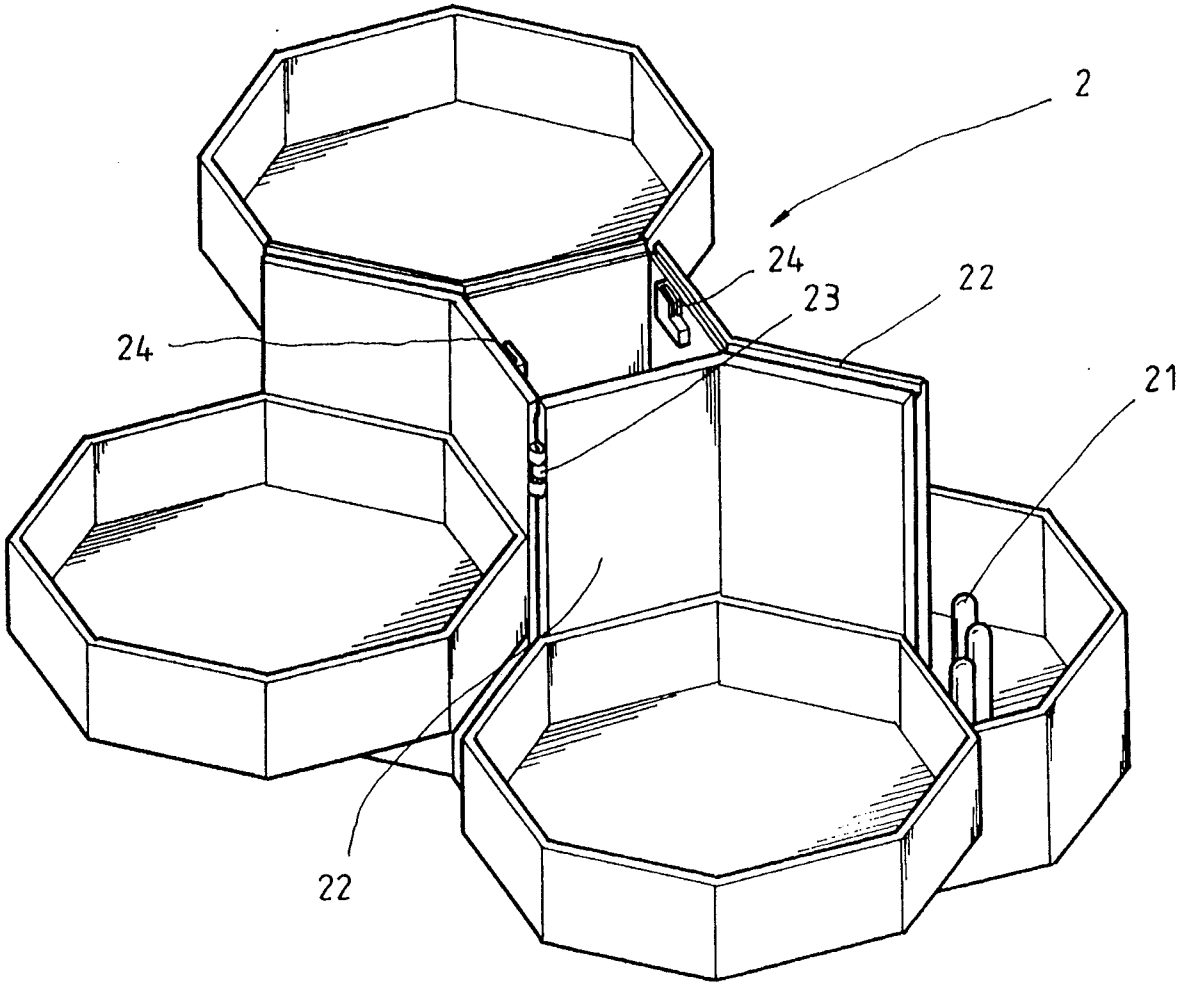
FIG. 3 is a perspective view of the collapsible multilayer container in another expanded status in accordance with the present invention.

Every two adjacent fences 22 of the housings 2 are pivoted by a plurality of connecting devices 23 mounted therebetween so that the housings 2 are rotatably collapsible to pile up to be an elongated octagonal container or rotatably expandable to form various charming appearances such as those shown in FIGS. 2 and 3.

Figure 4:
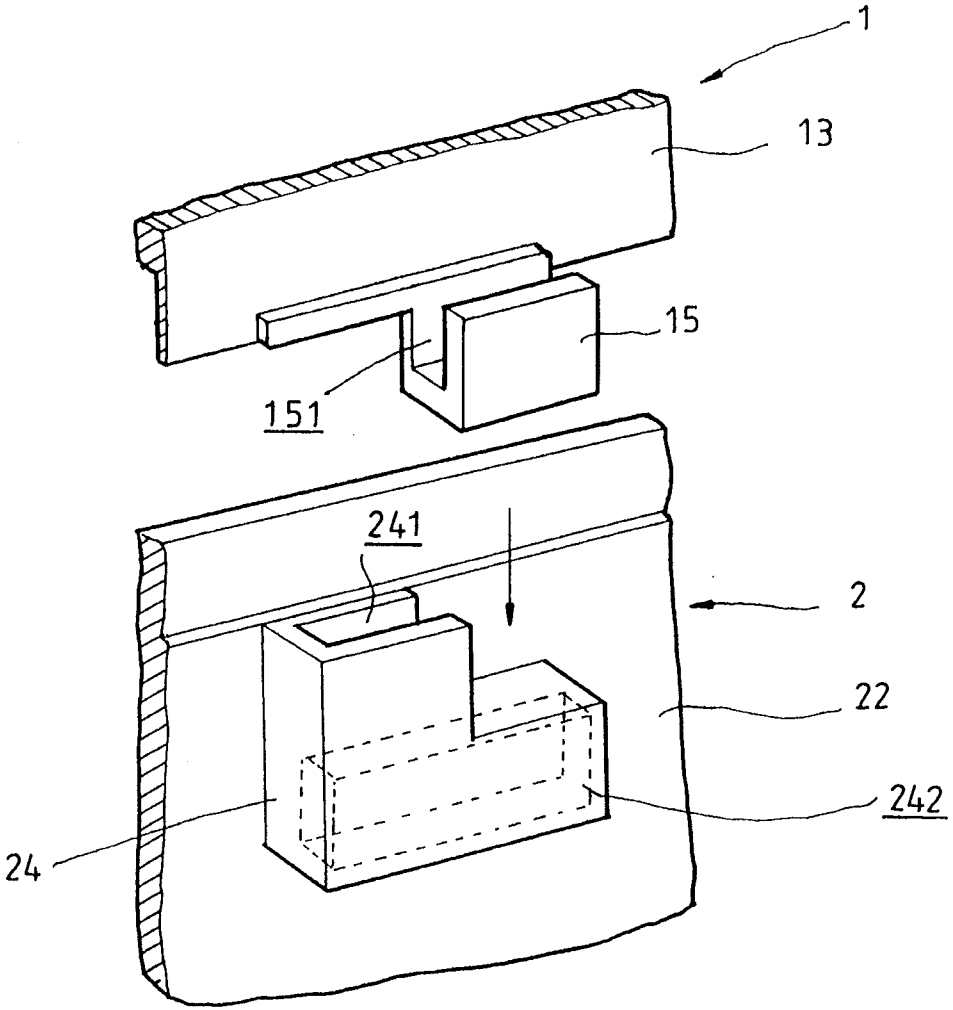
FIG. 4 is an enlarged perspective view of guiding members of the collapsible multilayer container in accordance with the present invention.

As shown in FIGS. 3 and 4, corresponding to the pair of the first guiding members 15 of the cover 1, the housings 2 comprise a pair of second guiding members 24 externally secured onto two opposite fences 22 thereof. Each of the second guiding members 24 appears L-shaped having an upper groove 241 and a lower groove 242 formed thereon.

After being collected, the top surfaces of all fences 22 of the housings 2 together form an octagonal opening to be engageable with the open lower end 14 of the cover 1. When the cover 1 covers the collapsed housings 2, each of the U-shaped first guiding members 15 is displaced onto respective L-shaped second guiding members 24, as shown in FIG. 4, to form a rectangular guiding assembly, as shown in FIG. 5. Therefore, the groove 151 of each first guiding member 15 and the upper groove 241 of each second guiding member 24 are arranged in a line to form a guiding channel to guidedly receive the upper bend 31 of each locking member 3 and at the same time the lower groove 242 of each second guiding member 24 guidedly receives the lower bend 32 of the locking member 3 in order to releasably lock the cover 1 to the housings 2, as shown in FIG. 1.

Having described the specific preferred embodiment of the present invention with reference to the accompanying drawings, it will be appreciated that the present invention is not limited to that precise embodiment and that various changes and modifications can be effected therein by one of ordinary skill in the art without departing from the scope or spirit of the invention as defined by the appended claims.

What is claimed is

1. A collapsible multilayer container comprising:

a cover including a pair of first guiding members secured on opposite side thereof;

at least a pair of interconnected housings, each of said housings defining an internal open space for receiving articles therein, each of said housing having a peripheral vertically extending wall with a portion of said peripheral wall having a vertically extending extension portion having an upper edge and extending upwardly therefrom, one of said extension portions being longer than another of said extension portions and rotatably interconnected to an adjacent extension portion, the overall length of one of said extension portions being substantially the same length as the overall height of an adjacent interconnected housing whereby said housings are rotatably collapsible together with one of said housings disposed above another adjacent housing;

second guiding means secured to the upper edges of said extension portions adapted to engage said first guiding means on said cover; and locking members releasably interconnecting said first and second guiding means whereby said cover may be secured to the upper edges of said extension portions closing off the internal open space of the uppermost one of said housing when rotated together.

2. A collapsible multilayer container as claimed in claim 1, wherein said cover comprises at least one handle pivotally connected thereto for carrying purpose.

3. A collapsible multilayer container as claimed in claim 2, wherein said cover has a groove formed thereon so that said handle is receivable within said groove.

4. A collapsible multilayer container as claimed in claim 1, wherein said first guiding member has a first groove and a second groove formed thereon, said second guiding member has a third groove formed thereon, said guiding assembly has a guiding channel defined thereon by said first groove and said third groove, and each of said locking members has a first end and a second end to be guidedly receivable within said guiding channel and said second groove so as to releasably lock said first and second guiding members.

5. A collapsible multilayer container as claimed in claim 1, wherein at least one said housings comprises at least one of rod formed therein for receiving a thread wound around.

* * * * *